US011014137B2

(12) United States Patent
Huang et al.

(10) Patent No.: US 11,014,137 B2
(45) Date of Patent: May 25, 2021

(54) WARM DIE TRIMMING IN HOT FORMING APPLICATIONS

(71) Applicant: Ford Motor Company, Dearborn, MI (US)

(72) Inventors: Liang Huang, Troy, MI (US); Evangelos Liasi, Royal Oak, MI (US)

(73) Assignee: FORD MOTOR COMPANY, Dearborn, MI (US)

( * ) Notice: Subject to any disclaimer, the term of this patent is extended or adjusted under 35 U.S.C. 154(b) by 593 days.

(21) Appl. No.: 15/795,196

(22) Filed: Oct. 26, 2017

(65) Prior Publication Data

US 2019/0126337 A1 May 2, 2019

(51) Int. Cl.

| | |
|---|---|
| ***B21D 22/02*** | (2006.01) |
| ***B21D 28/26*** | (2006.01) |
| ***B21D 24/16*** | (2006.01) |

(52) U.S. Cl.

CPC ..... *B21D 22/022* (2013.01); *B21D 24/16* (2013.01); *B21D 28/26* (2013.01)

(58) Field of Classification Search

CPC ..... B21D 24/08; B21D 24/16; B21D 28/26; B21D 22/022

See application file for complete search history.

(56) References Cited

U.S. PATENT DOCUMENTS

| | | | |
|---|---|---|---|
| 7,998,289 | B2 | 8/2011 | Brodt et al. |
| 9,050,641 | B2 * | 6/2015 | Cho ..... B21D 24/08 |
| 9,359,663 | B2 | 6/2016 | Mizuta et al. |
| 2011/0315281 | A1 | 12/2011 | Charest et al. |
| 2016/0244855 | A1 | 8/2016 | Steinebach et al. |

FOREIGN PATENT DOCUMENTS

| | | |
|---|---|---|
| CN | 103934360 | 7/2014 |
| CN | 105750397 | 7/2016 |
| WO | 2016/142367 | 9/2016 |

OTHER PUBLICATIONS

Choi, Hong-Seok et al., Application of Mechanical Trimming to Hot Stamp 22MnB5 Parts for Energy Saving, International Journal of Precision Engineering and Manufacturing, Jun. 2014, vol. 15(6) pp. 1087-1093 available at URL https://www.researchgate.net/publication/285416860_Application_of_Mechanical_Trimming_to_Hot_Stamped_22MnB5_Parts_for-Energy_Saving.

Mori, Ken-ichiro, Smart Hot Stamping of Ultra-High Strength Steel Parts, Transactions of Nonferrous Metals Society of China, Dec. 2012, vol. 22(2) pp. s496-s503, available at URL http://www.sciencedirect.com/science/article/pii/S100363261261752X.

* cited by examiner

*Primary Examiner* — Scott R Kastler
(74) *Attorney, Agent, or Firm* — Burris Law, PLLC

(57) ABSTRACT

A method of forming a part is provided by the present disclosure. The method includes forming a blank from a material, heating the blank, stamping the blank into a panel, and trimming the panel in a trim die. Trimming the panel includes heating a portion of the trim die locally adjacent a trim area of the panel at a temperature below an austenitizing (phase transformation) temperature of the material and trimming the panel with a cutting member.

20 Claims, 3 Drawing Sheets

WARM DIE TRIMMING IN HOT FORMING APPLICATIONS

FIELD

The present disclosure relates the field of hot stamping, pressing, and trimming of steel, and more specifically, boron steels.

BACKGROUND

The statements in this section merely provide background information related to the present disclosure and may not constitute prior art.

Boron steel sheets are often hot stamped in the manufacture of automotive parts. Ultra-high strength hot stamped parts reduce vehicle weight, resulting in increased fuel economy. As the parts also have a high strength, substantial increases in vehicle safety are achievable. Generally, the steel sheets are heated and then hot stamped, reducing forming loads and the amount of spring-back, thus increasing the formability characteristics of the boron steel. The hot stamped parts are subsequently sheared to remove unnecessary material from the parts. The shearing is commonly performed through a trimming, blanking, or punching process. As the hot stamped parts are often cooled or quenched prior to the shearing, the hardness, yield strength, and ultimate tensile strength of the boron steel sheets is often high, resulting in severe shearing tool wear, maintenance, and/or frequent replacement.

Current hot forming applications routinely use laser trimming cells to deliver trimmed parts that meet design intent. Laser trimming is a relatively expensive and time consuming process. However, due to the high hardness and strength (yield and ultimate tensile) of hot formed boron steel parts, the expense and efficiency of laser trimming is balanced against the expense of shearing tool wear, maintenance, and/or replacement (service life and expense).

Occasionally, partial trimming (e.g. hole piercing) is performed in the hot forming die during the hot forming process. Partial trimming is limited and highly dependent on several factors such as available die real estate, location of the trimming, number of trimmings, and size of the trimmings. Partial trimmings are less accurate and require larger tolerances, often increasing waste.

The present disclosure addresses the issues associated with trimming harder steels, such as boron steels, among other issues in the manufacture of such high-strength, lightweight materials.

SUMMARY

In one form of the present disclosure, a method of forming a part is provided. The method comprises forming a blank from a material, heating the blank, stamping the blank into a panel, trimming the panel in a trim die, and trimming the panel with a cutting member. The trimming of the panel in a trim die comprises heating a portion of the trim die locally adjacent a trim area of the panel at a temperature below an austenitizing temperature of the material.

In one form of the present disclosure, the cutting member is trim steel. In another form, the cutting member is not a laser. In still another form, the stamping and trimming steps are performed in separate stations. A portion of the trim die is heated using induction heating in one form, and in other forms, the heating is carried out by heat pipes, cartridge heaters, thermally sprayed heaters, tubular heaters, and combinations thereof. This heating may include simultaneously heating a plurality of trim areas of the panel, and further still, simultaneously heating a plurality of trim areas of the panel at a plurality of trim pads.

In another variation of the present disclosure, the portion of the trim die that is heated locally includes a ceramic material. In another form, a polyurethane material is between the ceramic material and the trim die.

In one form, the material of the blank is a boron steel and the temperature for heating a portion of the trim die is between 500° C. and 600° C. In this form, the blank is heated to about 930° C. before stamping, and the panel is cooled to below 200° C. before trimming with the cutting member.

In yet another variation, cooling the part is conducted within the trim die. Further still, the heating of a portion of the trim die locally is performed at a temperature to achieve predetermined mechanical properties for the part.

In another method according to the present disclosure, a method of trimming a part is provided. The method includes trimming a panel in a trim die, which comprises heating a portion of the trim die locally adjacent a trim area of the panel at a temperature below an austenitizing temperature of a material of the panel, and trimming the panel with a trim steel. In a variation of this method, a portion of the trim die is heated using induction heating in one form, and in other forms, the heating is carried out by heat pipes, cartridge heaters, thermally sprayed heaters, tubular heaters, and combinations thereof. In another variation of this method, the material is a boron steel and the temperature for heating a portion of the trim die is between 500° C. and 600° C. Similarly, the heating of a portion of the trim die locally may be performed at a temperature to achieve predetermined mechanical properties for the part.

In yet another method of the present disclosure, a method of trimming a boron steel part is provided. The method comprises trimming a boron steel panel in a trim die, wherein the trimming comprises heating a portion of the trim die locally adjacent a trim area of the boron panel to a temperature between 500° C. and 600° C., and then trimming the boron steel panel with a trim steel.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
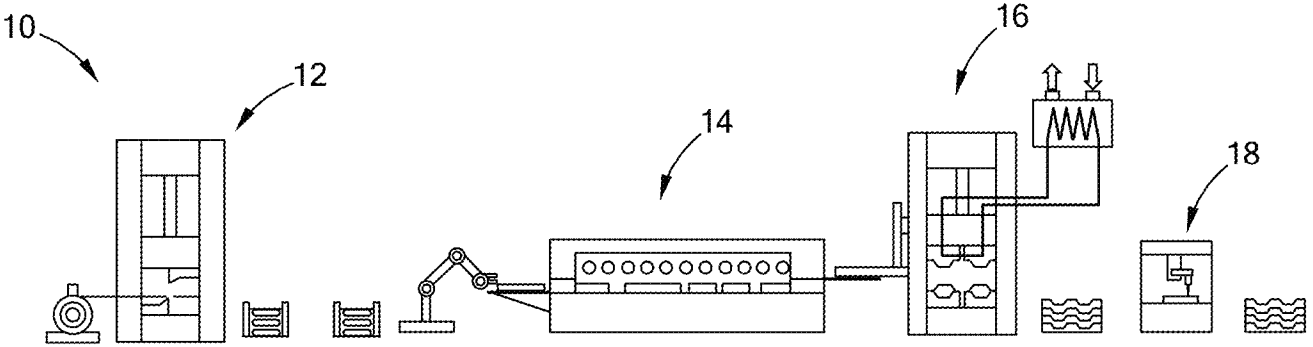
FIG. 1 PRIOR ART
FIG. 1 is a schematic illustration of a traditional manufacturing process for hot stamped boron sheet steel according to the prior art.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Referring to FIG. 1, a prior art process of hot stamping and laser trimming a boron steel part, or a steel part having a high hardness, is shown. The prior art process 10 generally includes the steps of blanking a boron steel sheet (12), transferring the blanks to a furnace for heating the blanks (14), transferring the heated blanks to a stamping die, stamping the heated blanks (16) into a panel, and finally laser trimming the panel (18). Because the hardness of the final panel is high, laser trimming is used to remove the excess material because conventional metal shearing tools will wear out too quickly.

Figure 2:
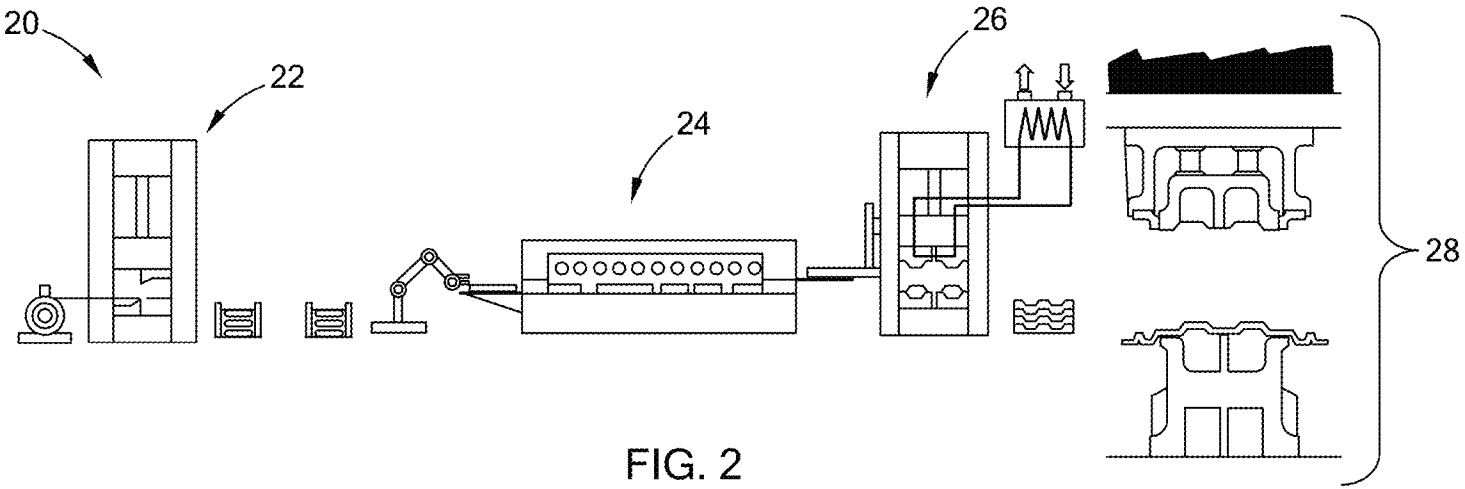
FIG. 2 is a schematic illustration of a manufacturing process for hot stamped boron sheet steel according to the teachings of the present disclosure.

Referring to FIG. 2, a method of forming a part according to the teachings of the present disclosure is illustrated and generally indicated by reference numeral 20. Generally, the method comprises forming a blank from a material (22), heating the blank (24), stamping the blank into a panel (26), and trimming the panel in a heated trim die (28). As shown, the stamping (26) and trimming steps (28) are performed in separate stations in one form of the present disclosure.

As described in greater detail below, a portion of the trim die is heated locally adjacent a trim area of the panel at a temperature below an austenitizing temperature of the material, and then the panel is trimmed with a cutting member. In other words, the material of the panel does not go through a phase change during the heating so as to maintain a predetermined level of mechanical properties in the final product. Because of the localized heating, the cutting member may be a conventional trim steel, and does not have to be a laser, thus reducing costs and improving throughput.

Figure 4:
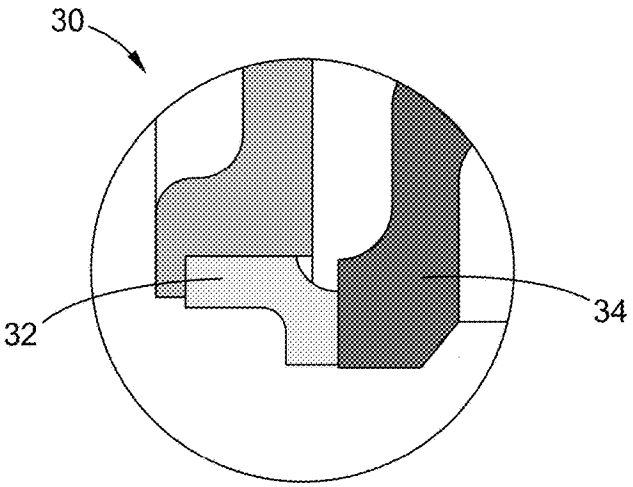
FIG. 4 is a detail view of portion of the trimming die of FIG. 3 according to the teachings of the present disclosure.
Figure 5:
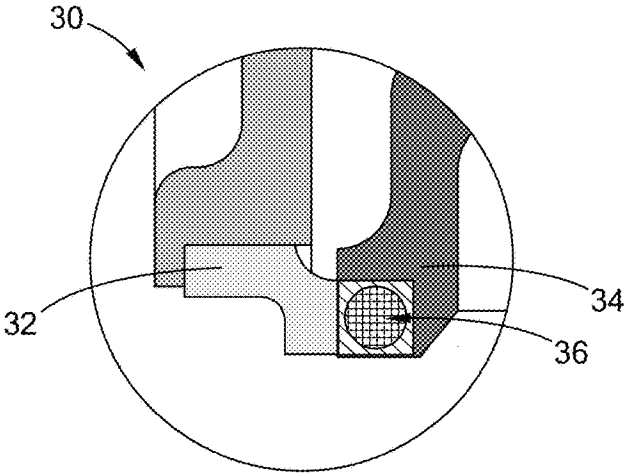
FIG. 5 is a detail view of portion of the trimming die of FIG. 3 according to one variation having a heater and constructed in accordance with the teachings of the present disclosure.
Figure 3:
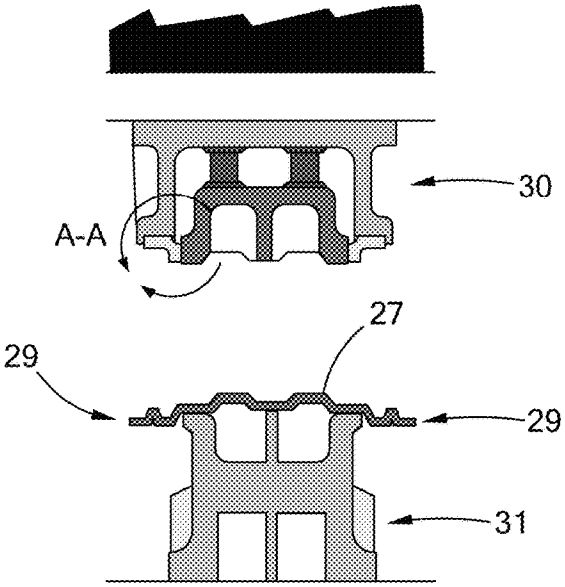
FIG. 3 is a side view of a trimming die constructed in accordance with the teachings of the present disclosure.

Referring now to FIGS. 3-5, a panel 27 is disposed on a bolster 31 and includes a trim area 29 around its periphery. The trim die 30 includes a cutting member 32, which in one form is a trim steel, to trim the trim area 29, along with and a trim pad 34 that abuts the trim steel 32. In one form, the trim die 30 includes a heater 36 configured to heat a portion of the trim die 30 locally, adjacent the trim area 29 of the panel 27. In one form, the heater 38 is an induction heater, however, the heater 38 may be any of a variety of types of heaters to achieve the desired temperature in a desired amount of time. For example, the heater 38 may be a heat pipe, a cartridge heater, thermally sprayed heater, a tubular heater, and combinations thereof, among others. One or a plurality of heaters may be employed in the trim die 30 depending on application requirements. It should also be understood that the localized heating may be achieved by an external heat source, and the trim die 30 may not necessarily have an integral heater 38 as illustrated and described herein.

Figure 6:
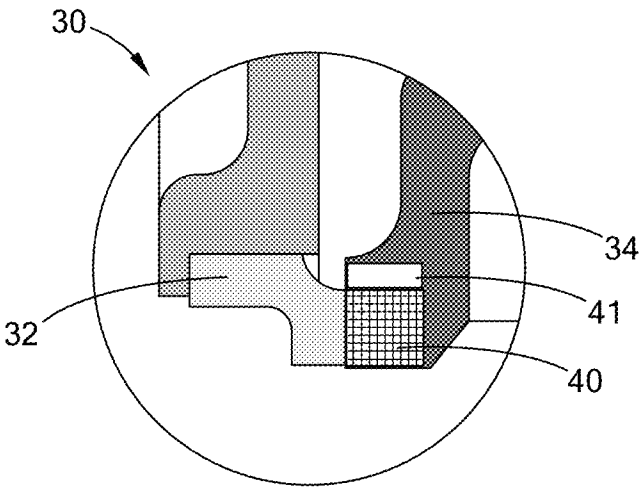
FIG. 6 is a detail view of portion of the trimming die of FIG. 3 according to another variation having a heater and an insulator constructed in accordance with the teachings of the present disclosure.

Referring now to FIG. 6, the trim die 30 may include an insulated portion 40, which is a ceramic material in one form, in order to direct the heat to the trim area 29 rather than being dissipated into the body of the trim die 30. In another form of the present disclosure, the trim die 30 includes an impact absorbing material 41 configured to protect the trim die 30 during trimming operations. In one form, this impact absorbing material 41 is polyurethane. Although not shown, the trim die 30 may have a plurality of trim areas, which may be simultaneously heated or independently heated, and further still, at the same or different temperatures at the plurality of trim areas.

In one form, the material being trimmed is a boron steel and the temperature for heating the portion of the trim die 30 is between 500° C. and 600° C. In one form, the blank is heated to about 930° C. before stamping, and the panel 27 is cooled to below 200° C. before trimming with the cutting member 32 between the temperature range of 500° C. to 600° C. The panel 27 may further be cooled within the trim die 30 after trimming before being transferred out of the trim die 30 for further processing. It should be understood that other types of materials may be employed and the present disclosure is not limited to boron steels. Other harder materials, which typically employ a laser trimming process, may also be trimmed according to the teachings of the present disclosure. With boron steels, heating the blanks to 500-600° C. will not initiate phase transformation and the material will be soft enough for trimming and thus reduce the tool wear on trim dies. Additionally, selectively heating hot formed blanks adjacent trim areas will reduce the geometric distortion when compared to the geometric distortion of parts that are sheared post-annealing.

Figure 7:
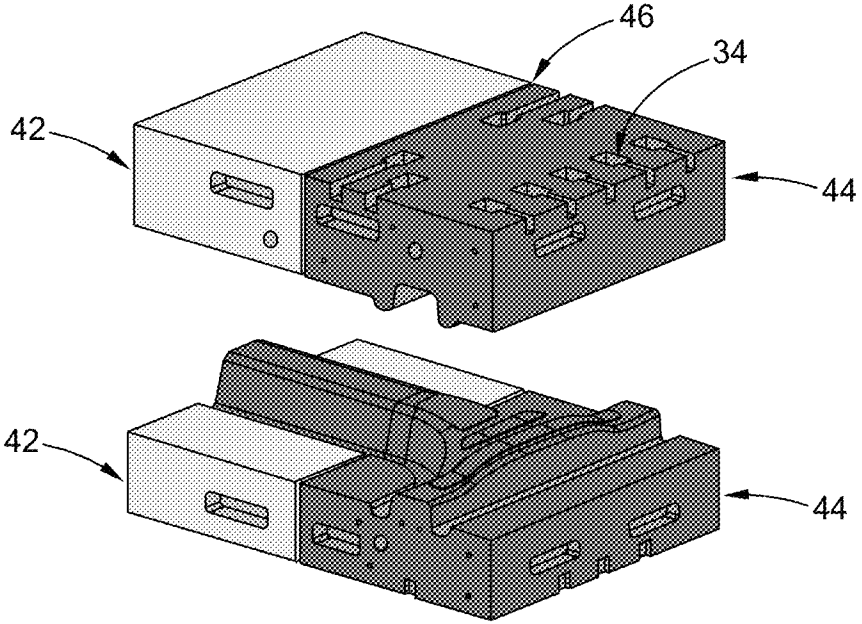
FIG. 7 is a perspective view of a trimming die having heated and cooled sections according to the teachings of the present disclosure.

In still another form, the heating is performed in order to achieve predetermined mechanical properties for the part, such a strength, ductility, and fracture toughness, among others. Accordingly, the part may be trimmed more cost effectively while at the same time improving the mechanical properties of the part. For example, Referring to FIG. 7, in one form the trim die 30 includes a cooled portion 42 and a heated portion 44. The cooled portion 42 and heated portion 44 separated by an air gap 46 for insulation between the cooled portion 42 and the heated portion 44. Although the insulation is air, it should be understood that other insulating means such as a dielectric material barrier may be provided while remaining within the scope of the present disclosure. In this form, a plurality of apertures 48 are formed in the heated portion 44 in order to accommodate the heaters 38 (not shown).

The present disclosure enables shorter trimming cycle times by preforming the shearing in less time than traditional trimming processes (mechanical and/or laser shearing). The present disclosure enables complete trimming in addition to partial trimming. By vibrationally isolating the trim die 30 from the surrounding environment, trimming of the trim areas can be isolated from vibration of the stamping equipment.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A method of forming a part comprising:

forming a blank from a material comprising steel;

heating the blank;

stamping the blank into a panel; and trimming the panel in a trim die, wherein the trimming comprises:

heating, with a heater, a portion of the trim die locally adjacent a trim area of the panel at a temperature below an austenitizing temperature of the material; and trimming the panel with a cutting member.

2. The method according to claim 1, wherein the cutting member is trim steel.

3. The method according to claim 1, wherein the cutting member is not a laser.

4. The method according to claim 1, wherein the stamping and trimming steps are performed in separate stations.

5. The method according to claim 1, wherein the step of heating a portion of the trim die includes induction heating.

6. The method according to claim 1, wherein the step of heating a portion of the trim die includes simultaneously heating a plurality of trim areas of the panel.

7. The method according to claim 6, wherein the heating is performed by one or more of the group consisting of heat pipes, cartridge heaters, thermally sprayed heaters, and tubular heaters.

8. The method according to claim 7, wherein the portion of the trim die that is heated locally includes a ceramic material.

9. The method according to claim 8 further comprising a polyurethane material between the ceramic material and the trim die.

10. The method according to claim 1, wherein the step of heating a portion of the trim die includes simultaneously heating a plurality of trim areas of the panel at a plurality of trim pads abutting the trim die.

11. The method according to claim 1, wherein the material is a boron steel and the temperature for heating a portion of the trim die is between 500° C. and 600° C.

12. The method according to claim 11, wherein the blank is heated to about 930° C. before stamping, and the panel is cooled to below 200° C. before trimming with the cutting member.

13. The method according to claim 1 further comprising the step of cooling the part within the trim die.

14. The method according to claim 1, wherein the heating of a portion of the trim die locally is performed at a temperature to achieve predetermined mechanical properties for the part, wherein the predetermined mechanical properties for the part is one or more of the group consisting of strength, ductility, and fracture toughness.

15. A method of trimming a part comprising:

trimming a panel comprising steel in a trim die, wherein the trimming comprises:

heating, with a heater, a portion of the trim die locally adjacent a trim area of the panel at a temperature below an austenitizing temperature of a material of the panel; and trimming the panel with a trim steel.

16. The method according to claim 15, wherein the step of heating a portion of the trim die includes induction heating.

17. The method according to claim 15, wherein the heating is performed by one or more of the group consisting of heat pipes, cartridge heaters, thermally sprayed heaters, and tubular heaters.

18. The method according to claim 15, wherein the material is a boron steel and the temperature for heating a portion of the trim die is between 500° C. and 600° C.

19. The method according to claim 15, wherein the heating of a portion of the trim die locally is performed at a temperature to achieve predetermined mechanical properties for the part, wherein the predetermined mechanical properties for the part is one or more of the group consisting of strength, ductility, and fracture toughness.

20. A method of trimming a boron steel part comprising:

trimming a boron steel panel in a trim die, wherein the trimming comprises:

heating a portion of the trim die locally adjacent a trim area of the boron panel at a temperature between 500° C. and 600° C.; and trimming the boron steel panel with a trim steel.

* * * * *